US011242498B2

(12) United States Patent
Botros

(10) Patent No.: US 11,242,498 B2
(45) Date of Patent: Feb. 8, 2022

(54) POLYOLEFIN COMPOSITIONS FOR GREASE AND LUBRICANT APPLICATIONS

(71) Applicant: EQUISTAR CHEMICALS, LP, Houston, TX (US)

(72) Inventor: Maged G. Botros, Liberty Township, OH (US)

(73) Assignee: Equistar Chemicals, LP, Houston, TX (US)

( * ) Notice: Subject to any disclaimer, the term of this patent is extended or adjusted under 35 U.S.C. 154(b) by 0 days.

(21) Appl. No.: 16/677,228

(22) Filed: Nov. 7, 2019

(65) Prior Publication Data

US 2020/0140778 A1 May 7, 2020

Related U.S. Application Data

(60) Provisional application No. 62/756,830, filed on Nov. 7, 2018.

(51) Int. Cl.
*C10M 169/02* (2006.01)
*C10M 113/02* (2006.01)
(Continued)

(52) U.S. Cl.
CPC ..... *C10M 169/02* (2013.01); *C10M 113/02* (2013.01); *C10M 113/10* (2013.01); *C10M 117/02* (2013.01); *C10M 119/02* (2013.01); *C10M 119/08* (2013.01); *C10M 121/02* (2013.01); *C10M 123/04* (2013.01); *C10M 123/06* (2013.01); *C10M 2201/0416* (2013.01);
(Continued)

(58) Field of Classification Search
CPC ..... C10M 169/02; C10M 113/02; C10M 113/10; C10M 117/02; C10M 119/02; C10M 119/08; C10M 121/02; C10M 123/04; C10M 123/06; C10M 2201/0416; C10M 2201/1036; C10M 2203/003; C10M 2203/1013; C10M 2205/022; C10M 2207/1265; C10M 2209/046; C10M 2209/0613; C10M 2205/0213; C10M 2203/1065; C10M 171/06; C10N 2020/06; C10N 2050/10; C10N 2020/04; C10N 2020/02; C10N 2020/017; C10N 2030/02; C10N 2030/10; C10N 2030/70; C10N 2030/68; C10N 2010/02
See application file for complete search history.

(56) References Cited

U.S. PATENT DOCUMENTS 3,432,431 A * 3/1969 Mitacek ..... C10M 5/00 508/591
6,413,915 B1 7/2002 Stehr

FOREIGN PATENT DOCUMENTS

GB 1232484 A 5/1971
JP 2014105252 A 6/2014

OTHER PUBLICATIONS

Polyolefins: Plastics Europe (Year: 2020).*
International Search Report and Written Opinion dated Apr. 14, 2020 (dated Apr. 14, 2020) for Corresponding PCT/US2019/060289.

* cited by examiner

*Primary Examiner* — Taiwo Oladapo

(57) ABSTRACT

A lubricant composition is described. The novel lubricant composition has superior thermal stability, and can reduce the need to replenish the lubricant. The lubricant composition includes at least a soap component, a thickener component, an oil component, and a spherical polyolefin component (optionally Microthene). The spherical polyolefin component includes polyolefin microparticles.

9 Claims, 6 Drawing Sheets

FN51000 FE53200 Novalin 515G

(51) Int. Cl.

| | |
|---|---|
| ***C10M 113/10*** | (2006.01) |
| ***C10M 117/02*** | (2006.01) |
| ***C10M 119/02*** | (2006.01) |
| ***C10M 119/08*** | (2006.01) |
| ***C10M 121/02*** | (2006.01) |
| ***C10M 123/04*** | (2006.01) |
| ***C10M 123/06*** | (2006.01) |
| *C10N 20/06* | (2006.01) |
| *C10N 50/10* | (2006.01) |

(52) U.S. Cl.

CPC ..... *C10M 2201/1036* (2013.01); *C10M 2203/003* (2013.01); *C10M 2203/1013* (2013.01); *C10M 2205/022* (2013.01); *C10M 2207/1265* (2013.01); *C10M 2209/046* (2013.01); *C10N 2020/06* (2013.01); *C10N 2050/10* (2013.01)

In the figure, the "top line" starting at about 1E+045 is BL 11B Base Oil Microthene FE53200; the "middle line" starting at about 1E+028 is BL 12C Base Oil Novalin 515G; the "bottom line" starting at about 1E+007 is ISO 20 base oil.

In the figure, the "top line" starting at about 1E+052 is BL OGL Light Microthene FE53200; the "middle line" starting at about 1E+0412 is BL 6C OGL Light Novalin 515G; the "bottom line" starting at about 1E+039 is OLG light. The middle and bottom lines do not cross.

POLYOLEFIN COMPOSITIONS FOR GREASE AND LUBRICANT APPLICATIONS

CROSS-REFERENCE TO RELATED APPLICATIONS

This application is the Non-Provisional Patent Applications, which claims benefit of priority to U.S. Provisional Application No. 62/756,830, filed Nov. 7, 2018, the contents of which are incorporated herein by reference in their entirety.

FIELD OF THE DISCLOSURE

The disclosure generally relates to a lubricant composition and method of making the same, and more particularly to a lubricant composition having polyolefin (optionally ethylene-vinyl acetate copolymer) fine particles as an additive to improve its rheological behavior as well as mechanical characteristics suitable for use in multiple applications including without limitation heavy machinery applications.

BACKGROUND OF THE DISCLOSURE

Grease is a semisolid lubricant. Grease generally consists of a soap emulsified with mineral or vegetable oil. The characteristic feature of greases is that they possess a high initial viscosity, which upon the application of shear, drops to give the effect of an oil-lubricated bearing of approximately the same viscosity as the base oil used in the grease. This change in viscosity is called shear thinning, which means that the viscosity of the fluid is reduced under shear.

In a typical grease composition, a thickener is included in order to increase the initial viscosity. Soaps are the most common emulsifying agent used, and the selection of the type of soap is determined by the application. Soaps include calcium stearate, sodium stearate, lithium stearate, as well as mixtures of these components. Fatty acid derivatives other than stearates are also used, including lithium 12-hydroxystearate. The nature of the soaps influences the temperature resistance (relating to the viscosity), water resistance, and chemical stability of the resulting grease.

Under high pressure or shock loading, normal grease can be compressed to the extent that the greased parts come into physical contact, causing friction and wear. When there is too much loss or degradation of the grease, replenishment is necessary. To prolong the working life, certain additives may be added. For example, solid lubricants, such as graphite and/or molybdenum disulfide, can be added to provide protection under heavy loadings. The solid lubricants bond to the surface of the metal, and prevent metal-to-metal contact and the resulting friction and wear when the lubricant film gets too thin.

SUMMARY OF THE DISCLOSURE

In one aspect, a lubricant composition is described. The lubricant composition comprises a soap component, a thickener component, an oil component, and a Microthene component. The Microthene component forms a better entanglement network with the oil and thickener components, which in turn contributes to improved thermal stability and work life of the lubricant.

As used herein, the term "Microthene" refers to a polyolefin resin microparticle that is spherical or substantially spherical and has an average particle size of 1-100 μm, in certain embodiments 1-20 μm, and in another embodiment 10-20 μm, with a narrow size distribution. The polyolefin may comprise high density polyethylene (HDPE), low density polyethylene (LDPE), or ethylene-vinyl acetate (EVA) co-polymer, or a mixture thereof.

The term "spherical" refers to the shape of a particle having the form of a sphere or of one of its segments and have a sphericity of at least 0.85. The sphericity of a particle is defined as the surface area of a sphere (with the same volume of a given particle) to the surface area of the particle:

$$\Psi = \frac{\pi^{\frac{1}{3}}(6V_p)^{\frac{2}{3}}}{A_p}$$

where $V_p$ is the volume of the particle, and $A_p$ is the surface area of the particle. A spherical particle will have the sphericity of 1.

By "substantially spherical in shape" it means that at least 80% of the particles are spherical, and in one embodiment, at least 85% of the particles are spherical.

The fine powders are, by virtue of their small particle size, narrow particle size range, and spherical particle shape, unique states of matter which cannot readily be prepared by other conventional processes known in the art. The advantages and utility of such fine powders has been described in many of the aforesaid patent disclosures. In addition, it has been found that various substrates can be coated by applying the above described dispersions of polyolefin fine powders in an inert carrier, heating to evaporate the carrier, and fusing the polyolefin to the substrate (U.S. Pat. No. 3,432,339). Further, U.S. Pat. No. 3,669,922 teaches a process for preparing colored polymer powders having controlled charge and printing characteristics of value as toners in electrostatic printing.

The term "grease," used interchangeably herein with "lubricant," refers to a lubricant composition that comprises at least a soap component and an oil component. Additional components include a wax thickener, and additives. The oil component may comprise a hydrocarbon or a synthetic oil, such as a polyalphaolefin. The thickener may be a paraffinic wax.

The term "soap" used herein refers to a non-detergent component in a lubricant composition as a form-release agent.

The term "lithium soap" refers to a soap that is a lithium derivative, i.e. a lithium salts of fatty acids. Lithium soaps are primarily used as components of certain lubricant greases. For lubrication, soaps derived from lithium are used due to their higher melting points. The main components of lithium soaps are lithium stearate and lithium 12-hydroxystearate. Grease made with lithium soap adheres particularly well to metal, is non-corrosive, may be used under heavy loads, and exhibits good temperature tolerance. Typically, it has a drip temperature of 190 to 220° C. (370 to 430° F.) and resists moisture, so it is commonly used as lubricant in household products, such as electric garage doors, as well as in automotive applications, such as CV joints.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention.

The following abbreviations are used herein:

| ABBREVIATION | TERM |
|---|---|
| EVA | Ethylene-vinyl acetate copolymer |
| LDPE | Low density polyethylene |
| HDPE | High density polyethylene |

DETAILED DESCRIPTION

Figure 1:
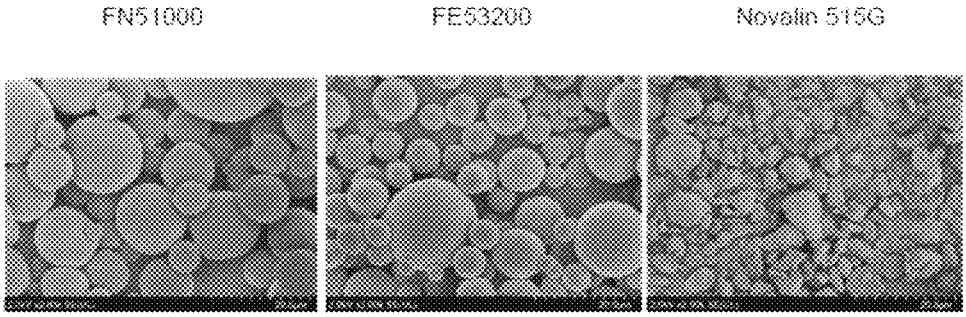
FIG. 1. Comparison of shapes of particles between Microthene FN51000, Microthene FE53200, and Novalin 515G using SEM microscopy.

In one aspect, a lubricant composition for use particularly in heavy machinery applications is described. The lubricant composition comprises a soap component, a thickener component, an oil component, and a Microthene component. The Microthene component may comprise polyolefin microparticles that are spherical or substantially spherical in shape.

In one embodiment, the polyolefin microparticles are EVA (ethylene-vinyl acetate) copolymer particles or low density polyethylene particles.

In one embodiment, the polyolefin particles have an average particle size of 1-100 μm. In another embodiment, the polyolefin particles have an average particle size of 5-50 μm. In another embodiment, the polyolefin particles have an average particle size of 10-30 μm.

In one embodiment, the lubricant composition comprises about 1-10 wt % of the polyolefin particles. In another embodiment, the lubricant composition comprises about 1-5 wt % of the polyolefin particles.

In one embodiment, the soap component is a lithium soap. In another embodiment, the lubricant composition comprises about 1-10 wt % of the lithium soap.

In one embodiment, the thickener comprises graphite, tar or mica, and the lubricant composition comprises about 1-6 wt % of the thickener.

In one embodiment, the lubricant composition comprises about 74-97 wt % of the oil component.

Microthene is a class of microfine polyolefin particles that are spherical in shape. In one embodiment, the Microthene has an average particle size ranges between 1-50 μm. In another embodiment, the Microthene has an average particle size ranges between 5-30 μm, or alternatively 5-25 μm, or alternatively 5-20 μm, or alternatively 5-15 μm, alternatively 5-10 μm. In one embodiment, the Microthene has an average particle size about the 20 μm range with a narrow size distribution. The Microthene as used herein may be comprised of low density polyethylene (LDPE) resins, high density polyethylene (HDPE) resins, or ethylene-vinyl acetate (EVA) copolymer resins.

Applicant has discovered that by adding Microthene into a lubricant composition in place of a conventional additive, such as Novalin 515G, it can improve thermal stability, gelling stability and shear-thinning characteristics of the lubricant composition.

The following embodiments were made with two Microthenes, FN51000 (LDPE) and FE53200 (EVA), both available from Lyondellbasell, Houston, Tex. However, it is envisioned that other types of Microthenes could achieve similarly improved results.

Material

Two types of greases were used in this application to experiment on the Microthene additives, including a light grease and a heavy grease. Both types of grease comprise a lithium soap component, a base oil component, and a graphite component, when the only difference being the amount of lithium soap in each type of grease. The light grease contains about 4 wt % of lithium soap and 3 wt % graphite, whereas the heavy grease contains about 8 wt % of lithium soap and 3 wt % graphite.

The base oil component as used herein comprises Cross L Series base oil that are severely hydro treated naphthenic process oils manufactured from select crude streams. However, other types of base oil can be used to make the lubricant composition, as long as its viscosity, pouring point, and other characteristics are suitable for its application.

The FN51000 Microthene as used herein is available from Lyondellbasell, Houston, Tex. FN51000 are polyolefin powders made of LDPE and are ultra-fine, spherically shaped particles with narrow size distribution suitable for use in a broad range of specialty applications. FN51000 typically has the following properties:

| Typical Properties | Nominal Value | English Units | Nominal Value | SI Units | Test Method |
|---|---|---|---|---|---|
| Physical | | | | | |
| Melt Flow Rate, (190° C./2.16 kg) | 5.3 | g/10 min | 5.3 | g/10 min | ASTM D1238 |
| Density, (23° C.) | 0.923 | g/cm$^3$ | 0.923 | g/cm$^3$ | ASTM D1505 |

-continued

| Typical Properties | Nominal Value | English Units | Nominal Value | SI Units | Test Method |
|---|---|---|---|---|---|
| Mechanical | | | | | |
| Flexural Modulus | 40000 | psi | 275.8 | MPa | ASTM D790 |
| Tensile Strength at Break | 1800 | psi | 12.4 | MPa | ASTM D638 |
| Tensile Elongation at Break | 550 | % | 550 | % | ASTM D638 |
| Hardness | | | | | |
| Shore Hardness, (Shore D) | 53 | | 53 | | ASTM D2240 |
| Thermal | | | | | |
| Vicat Softening Point | 206.6 | ° F. | 97.0 | ° C. | ASTM D1525 |
| Low Temperature Brittleness | <−105 | ° F. | <−76 | ° C. | ASTM D746 |
| Peak Melting Point | 230.0 | ° F. | 110.0 | ° C. | ASTM D3418 |
| Additional Information | | | | | |
| Particle Shape | Spherical | | Spherical | | LYB Method |
| Average Particle Size | 20 | micron | 20 | micron | LYB Method |
| Particle Size Distribution | 5-50 | micron | 5-50 | micron | LYB Method |
| Moisture Content | <=0.1 | % | <=0.1 | % | LYB Method |

The FE53200 Microthene as used herein is available from Lyondellbasell, Houston, Tex. FE53200 are polyolefin powders made of EVA and are ultra-fine, spherically shaped particles with narrow size distribution suitable for use in a broad range of specialty applications. FE53200 typically has the following properties:

| Typical Properties | Nominal Value | English Units | Nominal Value | SI Unite | Test Method |
|---|---|---|---|---|---|
| Physical | | | | | |
| Equivalent Melt Index | 8.0 | g/10 min | 8.0 | g/10 min | ASTM D1238 |
| Density, (23° C.) | 0.926 | $g/cm^3$ | 0.926 | $g/cm^3$ | ASTM D1505 |
| Mechanical | | | | | |
| Flexural Modulus | 135800 | psi | 93.1 | MPa | ASTM D790 |
| Tensile Strength at Break | 1700 | psi | 11.7 | MPa | ASTM D638 |
| Tensile Elongation at Break | 675 | % | 675 | % | ASTM D638 |
| Hardness | | | | | |
| Shore Hardness, (Shore D) | 38 | | 38 | | ASTM D2240 |
| Thermal | | | | | |
| Vicat Softening Point | 167.0 | ° F. | 75.0 | ° C. | ASTM D1525 |
| Low Temperature Brittleness | <−105 | ° F. | <−76 | ° C. | ASTM D746 |
| Peak Melting Point | 204.8 | ° F. | 96.0 | ° C. | ASTM D3418 |
| Additional Information | | | | | |
| Particle Shape | Spherical | | Spherical | | LYB Method |
| Average Particle Size | 20 | micron | 20 | micron | LYB Method |
| Particle Size Distribution | 5-50 | micron | 5-50 | micron | LYB Method |
| Moisture Content | <=0.1 | % | <=0.1 | % | LYB Method |

The Novalin 515G as used herein is a micronized wax having low molecular weight of about 1500 g/mol. Novalin 515G are particles with irregular shapes and an average particle size of about 5 μm.

Method

The testing was conducted at either room temperature or at elevated temperature (for example, 100° C.) in order to compare the physical characteristics.

Thermogravimetric Analyzer (TGA) Testing

Thermogravimetric Analyzer (TGA) is a technique in which the mass of a substance is monitored as a function of temperature or time as the sample specimen is subjected to a controlled temperature program in a controlled atmosphere. It is commonly used to determine selected characteristics of materials that exhibit either mass loss or gain due to decomposition, oxidation, or loss of volatiles such as moisture. For greases, TGA allows for the determination of weight loss characteristics of different base fluids or formulations resulting from evaporation, oxidation, or thermal cracking.

To conduct the testing, the TGA instrument continuously weighs a sample as it is heated or maintained at a defined temperature. Typically the sample is exposed to air or nitrogen atmosphere during testing. There are three types of thermogravimetry:

Dynamic TGA—where the sample is subjected to continuous increase in temperature (usually linearly) with time.

Isothermal TGA—where the sample is maintained at a constant temperature for a period of time during which change in weight is recorded.

Quasistatic TGA—where the sample is heated to a constant weight at each of a series of increasing temperature.

Noack volatility is defined as the mass of oil, expressed in weight %, which is lost when the oil is heated at 250° C. and 20 mmHg (2.67 kPa; 26.7 mbar) below atmospheric in a test crucible through which a constant flow of air is drawn for 60 minutes, according to ASTM D5800. A more convenient method for calculating Noack volatility and one which correlates well with ASTM D5800 is by using a thermo gravimetric analyzer test (TGA) by ASTM D6375.

After completion of the test, a plot of weight/mass against temperature or time as measured can be generated. The less weight/mass loss is considered a better grease/lubricant that is able to maintain its thermal stability under elevated temperature for a prolonged period of time.

Complex Viscosity

Complex viscosity is a frequency-dependent viscosity function determined during forced harmonic oscillation of shear stress. A TA Instruments ARES-G2 rotational rheometer with a parallel plate geometry was used to conduct a dynamic temperature sweep test. A pea-sized sample of the fluid or grease was deposited on the lower portion of a pair of disposable 25 mm aluminum plates. Plates were used as received. The top plate was lowered until contacting the fluid and the oven was closed around the parallel plate portion of the rheometer. The gap between the top and bottom plates was 0.5 mm. The strain amplitude was set at 20%. The temperature was maintained at 25° C. and held until system was in equilibrium, about 5 minutes. The top plate was then lowered until liquid oozed from edges of plates. An analysis program was then initiated.

The complex viscosity values of these compositions were plotted over several decades of frequencies with the purpose of trying to understand how the frequency, corresponding to the shear rate, would affect the viscosity of the fluid compositions. This is a significant test since many lubricants must work in a dynamic environment wherein the velocity, shear rate, or frequency of the moving or rotational parts varies with time. It would be desirable to have a more stable lubricant viscosity that does not significantly vary with the moving velocity or frequency of the working parts.

The actual setup or protocol for measuring the complex viscosity can vary, but the results should be the same or similar.

SEM Microscopy and Appearance

SEM microscopy photos were taken for Microthene FN51000, Microthene FE53200, and Novalin 515G, as shown in FIG. 1. It can be seen that both Microthene 51000 and 53200 particles are similarly spherical or substantially spherical in shape, whereas Novalin 515G particles have irregular shapes. The morphology may affect these additives' ability to form a homogeneous blend with the oil or grease, which in turn may affect its stability and thermal characteristics.

Blending Homogeneity

Figure 2:
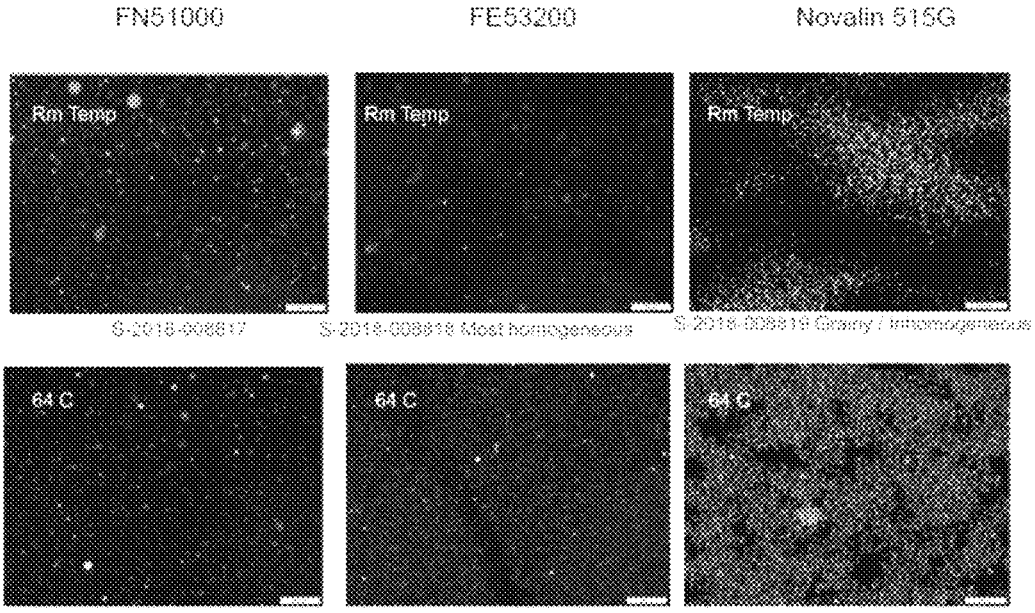
FIG. 2. Optical microscopy comparison of grease additives in a base oil under room temperature and elevated temperature (64° C., under polarized light).

Both Microthenes and Novalin 515G were added and blended with the base oil, both under room temperature and at 64° C. under polarized light. The ideal additive would result in a homogeneous blend with the additives suspended in the lubricant (as opposed to precipitation). Microscopic photos were taken for each blend, as shown in FIG. 2. It is shown that in either temperature conditions, Novalin 515G showed aggregation and inhomogeneous blending with the base oil. Microthenes, on the other hand, were much more homogeneously blended with the base oil.

Among the two Microthenes, FE53200 showed more homogeneous blending as compared to FN51000.

Suspension Properties

Room Temperature: Each of the additives were added to the base oil and underwent 15 minutes of ultrasonication at room temperature. Pure base oil was also ultrasonicated as the control. The resulting mixtures were set still at room temperature for up to 6 weeks.

The results (provided in FIG. 6) indicated that FN53200 formed a clear solution after two weeks with the base oil and FN51000 formed a slightly turbid solution, whereas Novalin 515G formed a turbid solution.

After one week (not shown in FIG. 6), particle settling was observed for Novalin 515G, whereas FE53200 did not settle. After six weeks (provided in FIG. 6), most of Novalin 515G had settled with severe separation and FN51000 showed some settling with moderate separation, whereas the FE53200 mixture was still a clear solution.

64° C.: Each of the additives were added to the base oil and underwent 15 minutes of ultrasonication at 64° C. Pure base oil was also ultrasonicated as the control. The resulting mixtures were set still at room temperature for up to 6 weeks.

The results (not shown) indicated that FN53200 initially formed a clear gel with the base oil, indicating co-crystallization or the microparticles became part of the main structure. FN51000 formed a more opaque solution, whereas Novalin 515G formed a turbid solution.

Figure 6:
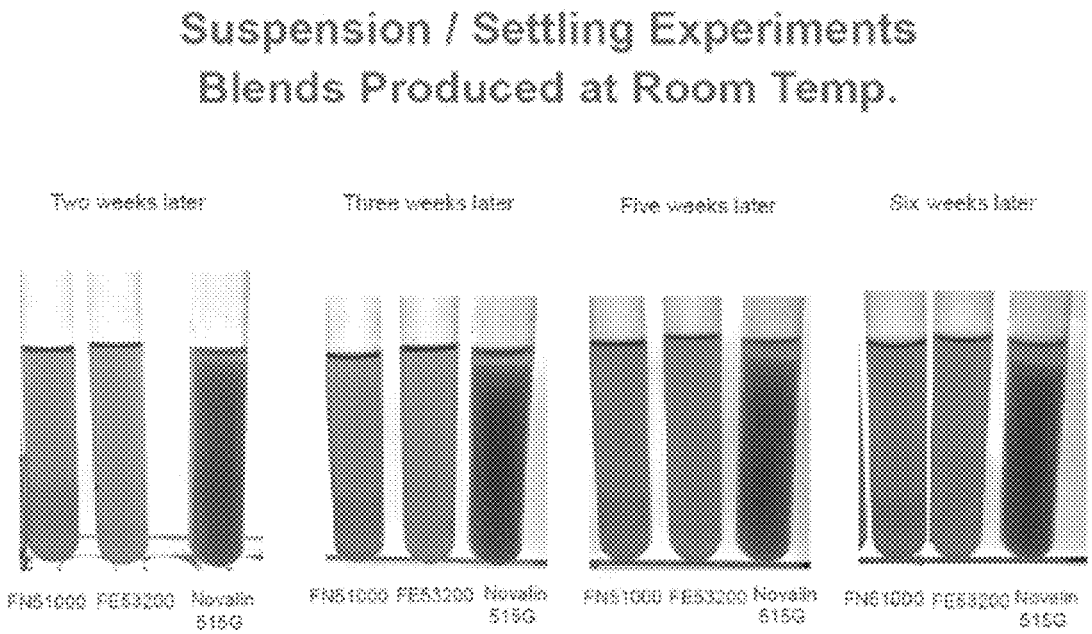
FIG. 6 Comparison of suspension/settling experiments at room temperature with base oil.

After two weeks, particle settling was observed for Novalin 515G, whereas FN51000 did not and FE53200 remained a gel. After six weeks (as shown in FIG. 6), most of Novalin 515G had settled and FN51000 showed some settling, whereas the FE53200 remained a high viscosity gel.

These results show that FE53200 was most homogeneously dispersed and formed the most tightly interconnected structure with the base oil.

Rheology

Base Oil: Approximately 5 wt % of Novalin 515G or Microthene FN51000 or FE53200 (all in powder form) was added to the base oil, and the mixtures were blended and measured at room temperature.

Figure 3:
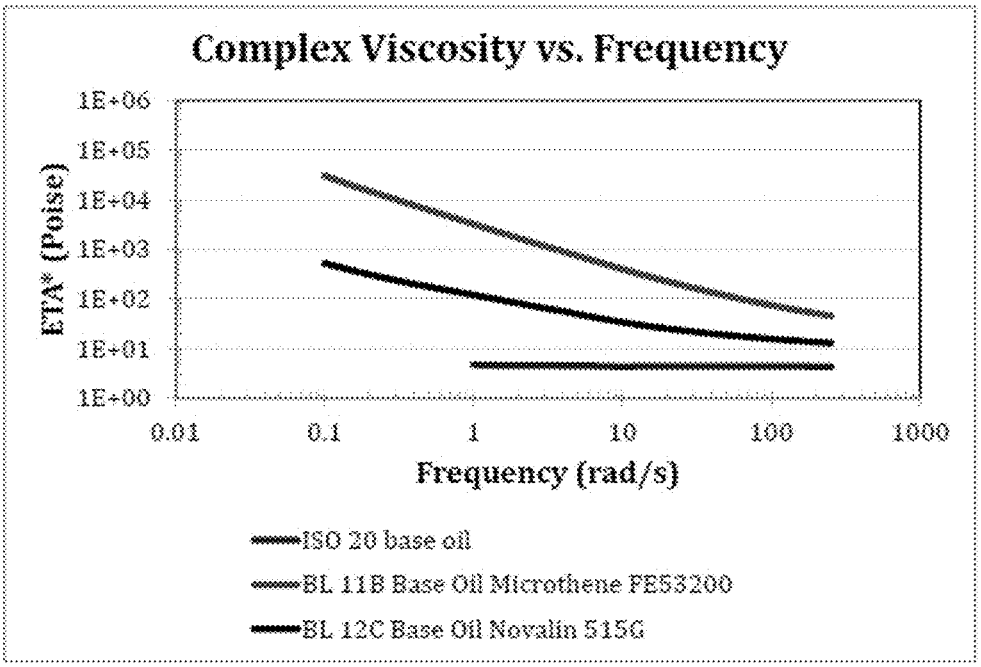
FIG. 3. Comparison of complex viscosity of Microthene FE53200 and Novalin 515G in base oil at room temperature.

The result is shown in FIG. 3. As can be seen, the FE53200 blend shows the highest viscosity even with shear thinning. Novalin 515G shows improved viscosity comparing to FN51000 or base oil alone.

Grease: Approximately 5 wt % of Novalin 515G or Microthene FN51000 or FE53200 (all in powder form) was added to either the light grease or the heavy grease. The mixture was blended at elevated temperature (66 to 100° C.), and measured at either room temperature or 100° C.

Figure 4:
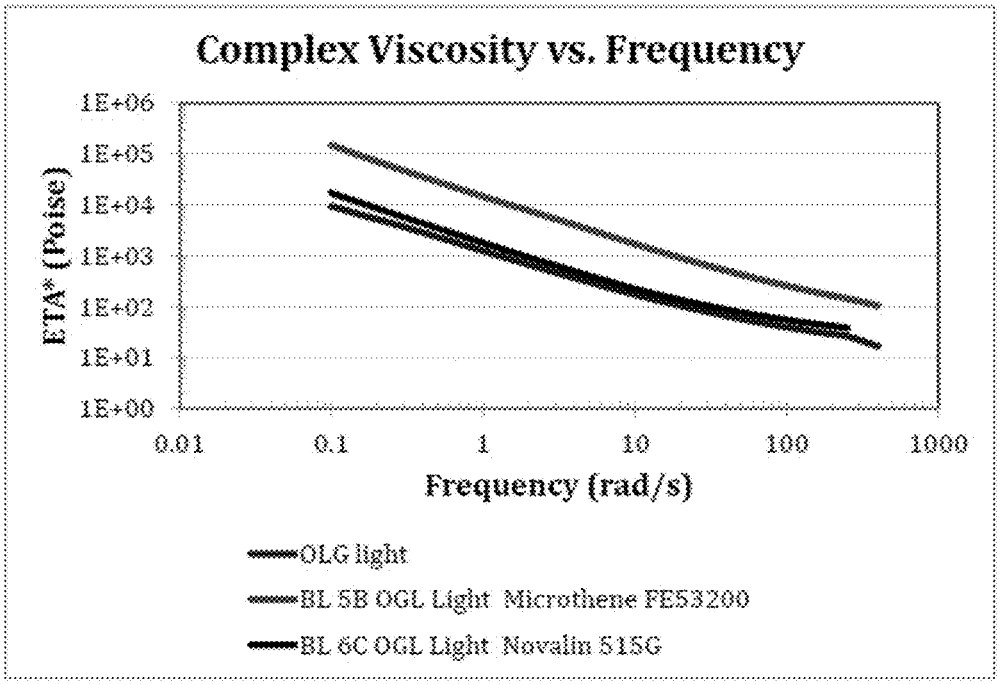
FIG. 4. Comparison of complex viscosity of Microthene FE53200 and Novalin 515G in light grease at room temperature.

The result of the light grease measured at room temperature is shown in FIG. 4. All viscosity curves show strong shear thinning behavior. As can be seen in FIG. 4, the FE53200 blend shows the highest viscosity.

Additional results are provided in the table below. According to Applicant's result, the highest peak viscosity was measured in the FE53200 blend, and the viscosity range indicates gel formation. The table provides the effect of Microthene on the viscosity at low and high shear rates. That effect is to increase or maintain the viscosity across a broad shear performance range. In an embodiment, Microthene may improve the viscosity across a broad shear performance range of base oil, light oil and heavy oil.

In the embodiment, a composition having base oil and Microthene may have a viscosity of from 50 to 150 poise (alternatively from 75 to 140 poise) at a frequency of 100 rad/sec and a viscosity of from 150 to 5000 poise (alternatively from 1500 to 3500 poise) at a frequency of 1 rad/sec. In the embodiment, a composition having light grease and Microthene may have a viscosity of from 75 to 500 poise (alternatively from 100 to 300 poise) at a frequency of 100 rad/sec and a viscosity of from 2500 to 25000 poise (alternatively from 10000 to 15000 poise) at a frequency of 1 rad/sec. In the embodiment, a composition having heavy grease and Microthene may have a viscosity of from 500 to 5000 poise (alternatively from 1000 to 2500 poise) at a frequency of 100 rad/sec and a viscosity of from 20000 to 150000 poise (alternatively from 50000 to 90000 poise) at a frequency of 1 rad/sec.

| Sample | Frequency (rad/scc) | ETA* (poise) |
|---|---|---|
| Heavy Grease Novalin 515G | 100 | 379 |
| | 1 | 17100 |
| Heavy Grease 2 Microthene FE53200 | 100 | 1790 |
| | 1 | 88900 |
| Heavy grease (oil alone) | 100 | 328 |
| | 1 | 15700 |
| Light Grease Microthene FE53200 | 100 | 258 |
| | 1 | 14600 |
| Light Grease Novalin 515G | 100 | 55 |
| | 1 | 1790 |
| Light grease (oil alone) | 100 | 40 |
| | 1 | 1250 |
| Base Oil Microthene FE53200 | 100 | 74 |
| | 1 | 3240 |
| Base Oil Novalin 515G | 100 | 16 |
| | 1 | 120 |
| base oil (oil alone) | 100 | 4 |
| | 1 | 5 |

The eta* (poise) was measured using a ARES-G2 Rheometer at room temperature (about 25 C.) at a 20 percent strain. The plates had a diameter of 25 millimeter, and the gap between the plates was 0.5 millimeters.

Thermal Analysis

In order to compare the thermal stability and characteristics of these additives, thermal analysis (TGA) was performed. Two sets of samples were prepared. The first set was each additive blending with the base oil only, and the second set was blending with the light and heavy grease. The TGA results for the first set are shown in FIG. 5.

Figure 5:
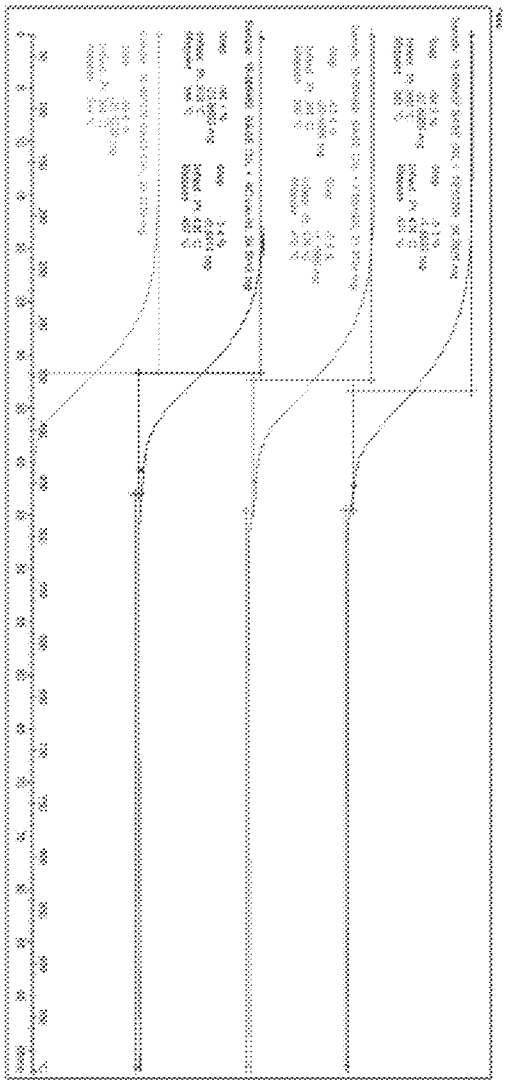
FIG. 5. Comparison of TGA results between Microthene FN51000, Microthene FE53200, Novalin 515G in base oil, and base oil alone as a control.

As can be seen in FIG. 5, the FE53200 blend and the FN51000 blend have similar midpoint temperature, with the FE53200 blend showing a little bit later endpoint. Both Microthene blends show better thermal stability than Novalin 515G.

Applicant's results indicate that adding Microthene additives, especially the EVA-based FE53200, can improve the thermal stability of the lubricant composition. This would allow the Microthene lubricant to have longer work life particularly in heavy machinery applications, resulting in less frequent need to replenish the lubricant, increase efficiency and reduce cost in the long run.

All of the compounds, complexes, and methods disclosed and claimed herein can be made and executed without undue experimentation in light of the present disclosure. It will be apparent to those of skill in the art that variations may be applied to the compounds, complexes, and methods describe herein, as well as in the steps or in the sequence of steps of the method described herein without departing from the concept, spirit, and scope of the technology. More specifically, it will be apparent that certain agents which are chemically related may be substituted for the agents described herein while the same or similar results would be achieved. All such similar substitutes and modifications apparent to those skilled in the art are deemed to be within the spirit, scope and concept of the technology as defined by the appended claims.

All references, patents and patent applications and publications that are cited or referred to in this application are incorporated in their entirety herein by reference.

What is claimed is:

1. A lubricant composition comprising:

1-10 wt. %, based on the total weight of the lubricant composition, of a soap component, 1-6 wt. %, based on the total weight of the lubricant composition, of a thickener component, 74-97 wt. %, based on the total weight of the lubricant composition, of an oil component, and wherein the oil component comprises a spherical polyolefin component, wherein the spherical polyolefin component comprises microparticles and wherein the polyolefin microparticles are EVA (ethylene-vinyl acetate) copolymer particles.

2. The lubricant composition of claim 1, wherein the polyolefin microparticles are spherical or substantially spherical in shape.

3. The lubricant composition of claim 2, wherein the polyolefin particles have an average particle size of 1-100 μm.

4. The lubricant composition of claim 2, wherein the polyolefin particles have an average particle size of 5-50 μm.

5. The lubricant composition of claim 1, wherein the lubricant composition comprises about 1-10 wt % of the polyolefin microparticles.

6. The lubricant composition of claim 1, wherein the soap component is stearate.

7. The lubricant composition of claim 6, wherein the lubricant composition comprises about 2-9 wt. % of the soap.

8. The lubricant composition of claim 1, wherein the thickener comprises graphite, tar or mica.

9. The lubricant composition of claim 1, wherein the lubricant composition comprises about 75-96 wt. % of the oil component.

* * * * *